US006443116B1

(12) United States Patent
Dahlborg

(10) Patent No.: US 6,443,116 B1
(45) Date of Patent: Sep. 3, 2002

(54) VALVE DEVICE FOR AN INTERNAL COMBUSTION ENGINE

(75) Inventor: Christer Dahlborg, Täby (SE)

(73) Assignee: AB Dafab, Taby (SE)

( * ) Notice: Subject to any disclaimer, the term of this patent is extended or adjusted under 35 U.S.C. 154(b) by 0 days.

(21) Appl. No.: 09/762,817

(22) PCT Filed: Jul. 26, 1999

(86) PCT No.: PCT/SE99/01316

§ 371 (c)(1),
(2), (4) Date: Feb. 12, 2001

(87) PCT Pub. No.: WO00/09865

PCT Pub. Date: Feb. 24, 2000

(30) Foreign Application Priority Data

Aug. 13, 1998 (SE) ..... 9802722

(51) Int. Cl.[7] ..... F01L 7/00

(52) U.S. Cl. ..... 123/190.6; 123/190.2; 123/190.8; 123/80 BA

(58) Field of Search ..... 123/190.2, 190.4, 123/190.6, 190.8, 190.16, 190.17, 80 BA, 190.14

(56) References Cited

U.S. PATENT DOCUMENTS

| | | | | |
|---|---|---|---|---|
| 1,079,741 A | * | 11/1913 | Calkins et al. | 123/190.8 |
| 1,166,397 A | * | 12/1915 | Woloff | 123/190.2 |
| 3,896,781 A | | 7/1975 | Smith | |
| 4,198,946 A | | 4/1980 | Rassey | |
| 4,333,427 A | | 6/1982 | Burillo et al. | |
| 4,342,294 A | | 8/1982 | Hopkins | |
| 4,976,227 A | * | 12/1990 | Draper | 123/190.2 |
| 5,329,897 A | * | 7/1994 | Hemphill et al. | 123/190.14 |
| 5,558,049 A | * | 9/1996 | Dubose | 123/190.14 |
| 5,673,663 A | * | 10/1997 | Kim | 123/190.4 |

FOREIGN PATENT DOCUMENTS

| | | | | |
|---|---|---|---|---|
| ES | 556787 | | 6/1986 | |
| ES | 8600542 | | 3/1988 | |
| GB | 579332 | * | 7/1946 | 123/190.2 |
| SE | 75025734 | | 5/1978 | |
| WO | WO8300722 | | 3/1983 | |

* cited by examiner

*Primary Examiner*—Noah P. Kamen
(74) *Attorney, Agent, or Firm*—Hovey Williams LLP

(57) ABSTRACT

The invention refers to a valve device for a combustion engine which includes a combustion chamber (1) and at least one channel (5) for communication between the combustion chamber (1) and an external space. The valve device includes a rotatable valve body (13), which is provided in said channel (5) and includes a passage (14) extending in a direction through said valve body (13). The valve body (13), which is rotatable around an axis of rotation forming an angle to the direction (p) of said passage (14), is arranged to open and close, respectively, said channel (5) by means of said passage (14) by rotation, a rotary motor (16) separated from the combustion engine is provided.

24 Claims, 5 Drawing Sheets

VALVE DEVICE FOR AN INTERNAL COMBUSTION ENGINE

BACKGROUND OF THE INVENTION

1. Field of the Invention

The present invention refers to valve device for a combustion engine including a combustion chamber and at least one channel for communication between the combustion chamber and an external space.

2. Description of the Prior Art

Such valve devices for combustion engines are known through, for instance, SE-B-401 387. The known valve device includes a rotatable valve body having a passage for the inlet channel and a passage for the outlet channel, which passages extend through the rotatable valve body. This provides for rotation of the valve body by means of a drive-wheel which is connected to the crank shaft of the combustion engine via a drive belt. The rotation of the valve body will thereby be timely related to the rotation of the crank shaft, and in the example provided in this patent the relation of the numbers of revolutions is 1:4. Consequently, the known valve body rotates at a substantially lower velocity than the crank shaft, which is an advantage per se. Furthermore, the valve body rotates continuously together with the crank shaft, i.e. the valve body rotates the whole time at a speed which is proportional to the speed of the crank shaft. This means that the inlet and outlet passages will be opened and closed successively and merely be substantially completely open during a very short time period. The suction procedure and the exhaust procedure will thereby be disturbed by the fact that these passages are merely partly open during a great part of said procedures. Certainly, SE-B-401 387 proposes to provide moveable sealings in the spaces at each side of the inlet and outlet channel, respectively, of the combustion chamber. The moveable additional valves thus enable a certain control of the times for the opening and the closing of the inlet and the outlet valves, respectively, as a function of the number of revolutions of the engine, for instance. However, the possibilities to vary the times appear to be limited and in addition, the construction is fairly complicated and involves a plurality of further components.

U.S. Pat. No. 4,976,227 discloses a combustion engine having rotatable valve bodies for the opening and closing, respectively, of the suction channel and the exhaust channel to the combustion chamber of the combustion engine. However, this document does not disclose any common rotary motor but the rotation of the valve body is provided by means of an electromagnetic arrangement, a so-called solenoid, wherein the electromagnets are activated and deactivated alternately in order to provide a discontinuous movement of the valve body. Thus, the valve bodies will be completely still in the positions obtained. No measures are disclosed to make the valve body rotate in a desired direction.

SUMMARY OF THE INVENTION

The purpose of the present invention is to remedy the problem mentioned above and provide a valve device which has a rotatable valve body and which enables a more instantaneous opening and closing of a suction and/or exhaust channel of a combustion engine. Furthermore, the present invention aims to provide improved possibilities to control such a valve.

The present invention obtains this purpose by the initially defined valve device characterised by a rotary motor being separated from the combustion engine and being arranged to provide said rotation. Such a separate rotary motor may be driven independently of the rotation of the crank shaft, which permits the valve body to be discontinuously rotated. That is, the valve body is rotated at different speeds and thereby very fast during the opening or closing phase of the valve device. In this way it is possible to avoid a slowly successive opening and/or closing of the valve device. Furthermore, an advantage of such a rotating valve is that it merely needs to rotate one revolution, whereas the crank shaft rotates four revolutions, i.e. the wear may be kept on a low level. Furthermore, such a rotating valve has substantially fewer mechanical parts than conventional cam shaft controlled valves.

According to an embodiment of the invention, the rotary motor is consequently arranged to rotate the above mentioned valve body from one of its positions to an adjacent one of its positions by a first high rotation velocity, to then rotate the valve body from this adjacent position by a second low rotation velocity, and to rotate the valve body from this adjacent position to the next adjacent position. The first time period, during which the valve body rotates from one position to another, is consequently advantageously substantially shorter than the second time period during which the valve body rotates in a position. The actual position thus includes an interval and not only one single position. This means that an inlet channel may be kept completely open during substantially the whole suction stroke of the engine and an outlet valve may be kept substantially completely open during the exhaust stroke. The second low rotation velocity may be permitted to vary with the number of revolutions per time unit of the combustion engine in such a manner that, at a relatively low number of rounds, the second rotation velocity may be substantially zero, i.e. the valve body is essentially stationary. At a relatively high number of revolutions, the second low rotation velocity may have a low value above zero, i.e. the valve body may advantageously be permitted to rotate at a low velocity. This facilitates the achievement of a very high first velocity for moving the valve body from one of said positions to an adjacent position.

According to a further embodiment of the invention, a control unit is arranged to control the rotation of the rotary motor. Thereby, a first sensor member may be arranged to sense the position of a crank shaft of said combustion engine. It is thereby possible to control the rotation of the rotary motor by means of the control unit in response to the sensed crank shaft position. That is, the control unit may initiate a very quick rotation of the valve body at a certain crank shaft position in order to open an inlet valve, for instance, at the upper dead center, and control the rotary motor in such a way that it does not rotate during a certain angle interval. Where the combustion engine is a four-stroke engine, the first sensor member advantageously includes two sensors which are known per se, which enable an exact identification of the position of each piston with regard to the whole stroke, two revolutions of the crank shaft. Furthermore, a second sensor member may be arranged to sense the number of revolutions per time unit of the combustion engine, wherein the control unit is arranged to control the rotation of the rotary motor in response to the number of revolutions. In such a manner, it is easily possible to change the opening and closing time, respectively, of the valve body in response to the number of revolutions of the combustion engine. Furthermore, the control unit may be arranged to control the valve body in order to control the number of revolutions per time unit of the combustion engine. Thereby, it is possible to dispense with conventional throttles in the carburettor or with the air control in case of direct injection.

According to a further embodiment, in which the combustion engine includes an inlet channel for the supply of air and fuel to the combustion chamber and an outlet channel for the discharge of combustion gases from the combustion chamber, the valve device includes a first rotatable valve body, which is provided in the inlet channel and includes a first passage extending in a direction through the first valve body. In this further embodiment, a second rotatable valve body is provided in said outlet channel and includes a second passage extending in a direction through the second valve body. Such valve bodies are especially suitable for controlling the suction and the exhaust in a four-stroke engine.

According to a further embodiment of the invention, the first and the second valve bodies form a body with a common axis of rotation, wherein the direction of the first passage forms an angle to the direction of the second passage. Both the inlet valve and the outlet valve for a combustion chamber may thereby be controlled by one single rotary motor. This angle between the directions of the passages may be between 30° and 60°, preferably about 45°.

According to another embodiment of the invention, the first valve body is provided beside the second valve body, wherein their axes of rotation of the valve bodies are substantially parallel. Two rotating valves are consequently provided for each combustion chamber, i.e. one for the inlet valve and one for the outlet valve. The first valve body and the second valve body may advantageously be driven by a common rotary motor, wherein a transferring member having an input shaft and an output shaft, which do not coincide, may be arranged to transfer a movement of rotation of the rotary motor to at least one of these first and second valve bodies. Alternatively, the first valve body and the second valve body may be driven by a respective separate rotary motor. This creates possibilities for controlling the inlet valve and the outlet valve independently of each other; for instance the time for the opening of the inlet valve may be adjusted without influencing the time for the opening of the outlet valve. Thereby, the control unit may be arranged to control the phase position of one of the valve bodies in relation to the phase position of the other valve body in response to said number or rounds.

According to a further embodiment of the invention, the rotary motor includes an electric rotary motor. An electric motor may be controlled in an easy manner and react quickly on different control signals. Preferably, the electric motor includes a synchronous motor. The synchronous motor may be of a high-speed type with a low inductance and a low moment of inertia. Such a motor may be accelerated very quickly. Thanks to the low inductance, the voltage will rapidly feed the necessary current through the windings of the synchronous motor. A low moment of inertia may, for instance, be provided by the feature that the synchronous motor has a rotor with a low weight. Such a low weight may be obtained by a magnet material including samarium/cobalt and/or neodymium. It is also possible to let the rotary motor include a pneumatic and/or hydraulic rotary motor.

According to a further embodiment of the invention, the combustion engine includes more than one combustion chamber, wherein the valve body for at least two combustion chambers may have a common axis of rotation and may be connected to each other by a power transferring connecting member. The connecting member may advantageously include a permanent magnet of each of the valve bodies and be arranged to enable contact-free power transmission from one valve body to an adjacent valve body. Adjacent valve bodies may thereby be completely separated from each other, for instance by any wall member, which enables a proper sealing between the valve bodies. However, it is also possible to let the connecting member include a connecting element extending between two adjacent valve bodies.

According to a further embodiment of the invention, the valve body is enclosed in a sleeve, which is arranged to be received by a cylinder head of said combustion engine. Such a sleeve with a valve body may be provided as a module unit, which facilitates replacement and mounting of the valve device in the cylinder head of a combustion engine.

BRIEF DESCRIPTION OF THE DRAWINGS

The present invention is now to be explained more closely by means of preferred embodiments and with reference to the drawings attached, wherein.

DETAILED DESCRIPTION OF PREFERRED EMBODIMENTS OF THE INVENTION

Figure 1:
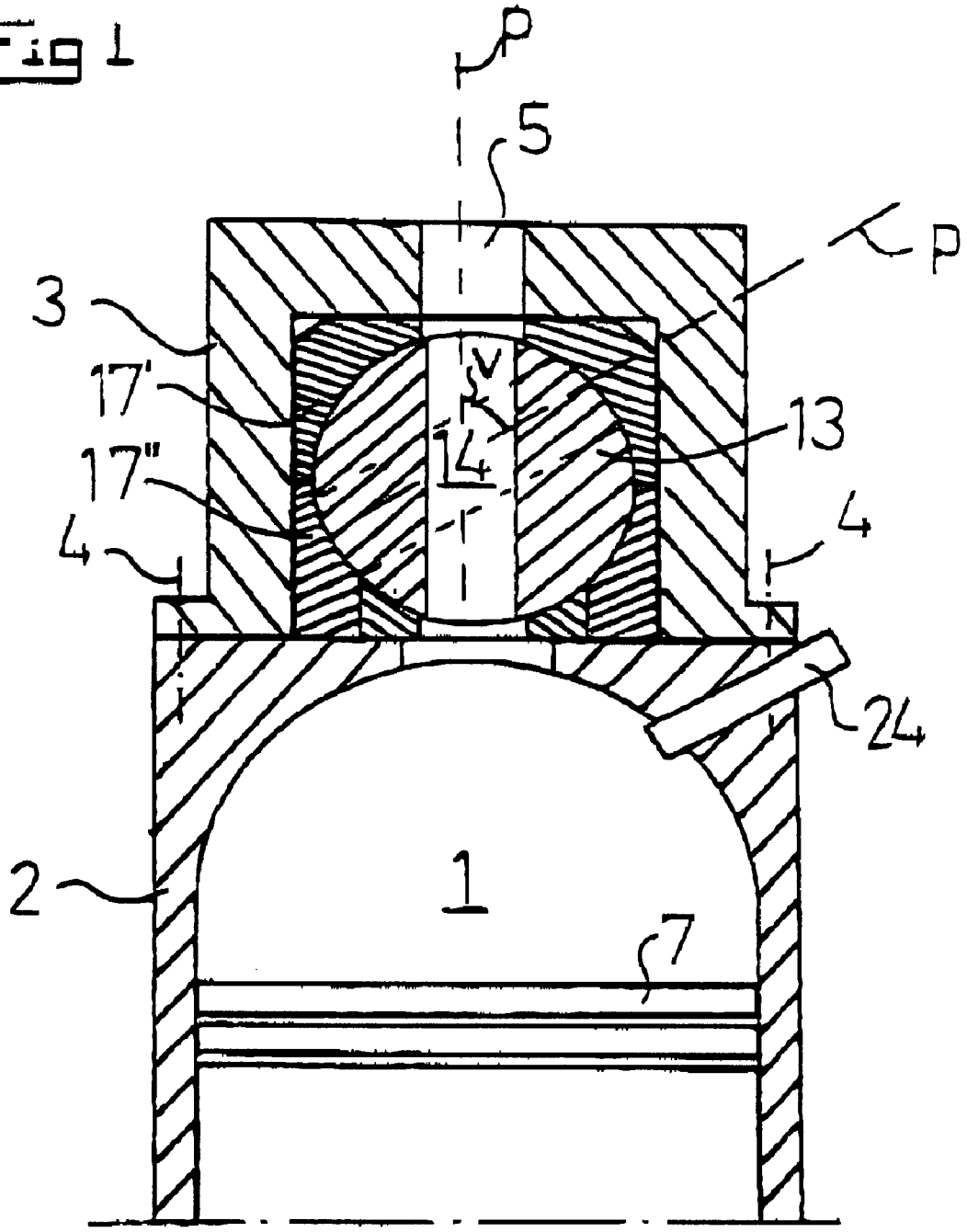
FIG. 1 discloses a transverse section through a part of a combustion engine with a valve device according to one embodiment of the invention.
Figure 2:
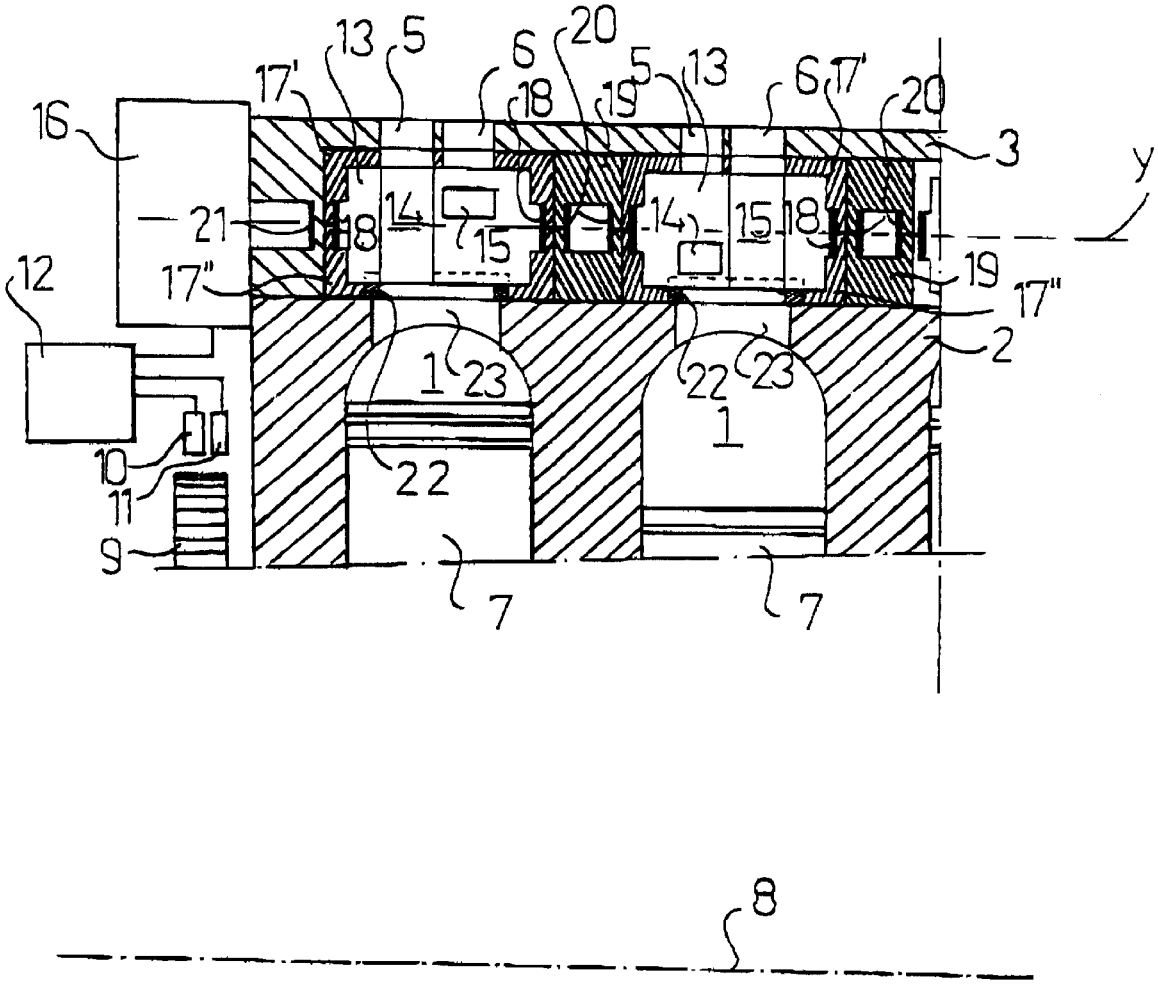
FIG. 2 discloses a longitudinal section through a part of a combustion engine in FIG. 1.

FIGS. 1 and 2 schematically disclose an upper part of a four-stroke combustion engine. The combustion engine may, for instance, include four cylinders or combustion chambers 1, two of which are disclosed in FIG. 2. However, it is to be noted that the invention is applicable to many different types of combustion engines, four-stroke engines as well as two-stroke engines. The number of cylinders or combustion chambers 1 may be arbitrary. Furthermore, the invention is applicable to Otto engines as well as to diesel engines.

The disclosed combustion chambers 1 are provided in an engine block 2 in a conventional manner. Above the engine block 2, a cylinder head 3 is provided. The cylinder head 3 may be mounted to the engine block 2 in a conventional manner by means of indicated bolts 4. The cylinder head 3 includes an inlet channel 5 for each combustion chamber 1 for the supply of a mixture of fuel and air and an outlet channel 6 for each combustion chamber 1 for the discharge of combustion gases. Furthermore, a piston 7 is provided in each combustion chamber 1. Each piston 7 is connected in a conventional manner via a connecting rod (not disclosed) to a crank shaft, which is indicated by the dotted-dashed line 8. The crank shaft 8 is connected to a tooth wheel 9 located outside the engine block 2. By means of sensor members 10 and 11, schematically disclosed, the position and the number of revolutions, respectively, of the crank shaft 8 may be sensed by sensing the positions of the tooth wheel 9. It is to be noted that the position sensing member 10 may include a resolver or a pulse sensor and be of such a type that it makes it possible to differ between two revolutions forming a stroke in a four-stroke engine. The sensor members 10 and 11 are connected to a control unit 12, which is to be disclosed more closely below.

According to the present invention, the valve device controlling the opening and closing of the inlet channel 5 and the outlet channel 6 includes a valve body 13, which is rotatable around an axis y of rotation. In the example disclosed, the axis y of rotation is parallel with the axis of rotation of the crank shaft 8. In the example disclosed in FIGS. 1 and 2, a rotatable valve body 13 is provided for each combustion chamber 1. Consequently, the valve body 13 includes two passages, namely, one inlet passage 14 and one outlet passage 15. Each passage 14, 15 extends in a direction p, and the direction p of the inlet passage 14 forms an angle v to the direction p of the outlet passage 15, which in the example disclosed is about 45°. As appears from FIG. 2, the inlet passage 14 is provided to be located in line with the inlet channel 5 two times per revolution of the rotating valve body 13. In the same way, the outlet passage 15 is arranged to be located in line with the outlet channel 6 two times per round. The rotation of the valve bodies 13 is provided by means of a separate electric drive motor in the form of a rotary motor 16 via a power-transmission arrangement to be described more closely below. In the same way as for the crank shaft, the device may include members (not disclosed) for measuring and transferring the rotation position of the rotary motor 16 for each point of time.

Each valve body is provided in a sleeve including an upper part 17' and a lower part 17". The rotatable valve body 13 is substantially completely enclosed in the sleeve 17', 17", which in its turn is received in a recess of the cylinder head 3. The sleeve 17', 17" and the valve body 13 provided therein form a separate module unit which is easily replaceable. Each valve body 13 has two end portions, which each includes a permanent magnet 18. A power transmission element is provided which includes a rotatable permanent magnet 20 and is located between each such module unit[, a power transmission element is provided, which includes a rotatable permanent magnet 20]. Furthermore, the rotary motor 16 has an output shaft with an outer end portion which includes a permanent magnet 21. The permanent magnet 21 and the adjacent permanent magnet 18 of the first rotatable valve body 13 will thus take a fixed turning position in relation to each other as well as also the second permanent magnet 18 of the first valve body 13 and the permanent magnet 20 of the power transmission element 19, etc. The rotation of the rotary motor 16 may thus be transferred to all valve bodies 13 in the row of combustion chambers 1 included by the motor.

A sealing element 22 is provided above each combustion chamber 1 between the rotatable valve body 13 and the engine block 2. The sealing element 22 has, as appears from FIG. 1, a concave cylindrical surface, against which the surface of the valve body 13 abuts. Furthermore, the sealing element 22 has a plane lower surface, which partly abuts the upper surface of the engine block 2. A passage 23 extends from the upper surface of the engine block 2 to the combustion chamber 1. As appears from FIGS. 1 and 2, the sealing element 22 extends with a part of the lower surface into the passage 23. This means that, during the compression stroke and the combustion stroke, the sealing element 22 will be pressed against the rotatable valve body 13 and ensure the sealing of the combustion chamber 1 in relation to the surroundings.

In a four-stroke motor having the valve device according to the invention, the valve body 13 will take the position disclosed in FIGS. 1 and 2 during the suction stroke of the motor. Thereby, the control unit 12 controls the rotary motor 16 whereby, during an essential part of the suction stroke, the valve body 13 is substantially still-standing at low numbers of revolutions of the combustion engine in the position disclosed. When the crank shaft 8 has reached the lower dead point, i.e. bottom dead center, the piston 7 turns upwardly at the same time as the control unit 12 activates the rotary motor 16 to rotate the rotatable valve body 13 by a high velocity about 22, 5°. During the compression stroke, the valve body 13 will thus close the inlet channel 5 and also the outlet channel 6. When the crank shaft 8 has reached the upper dead point, i.e. top dead center, the combustion is initiated by means of a schematically disclosed spark-plug 24, whereas the control unit 12 initiates the rotary motor 16 to rotate the rotatable valve body 13 a further quarter of a revolution. Consequently, both the inlet channel 5 and the outlet channel 6 will be closed also during the combustion stroke. When the crank shaft 8 has reached the lower dead point once again, the control unit 12 initiates the rotary motor 16 to rotate the valve body 13 a further quarter of a revolution, which means that the outlet passage 15 will be in line with the outlet channel 6, i.e. the combustion gases may leave the combustion chamber 1 during the exhaust stroke. Consequently, the rotary motor 16 will rotate discontinuously, i.e. be substantially still-standing or rotate at a very low velocity during a relatively long period of time and rotate at a very high velocity during a relatively short period of time between the different strokes of the combustion engine. The rotary motor 16 is arranged to rotate in one single direction of rotation. This may be obtained by means of the control unit 12, which includes suitable electronics known per se.

Figure 3:
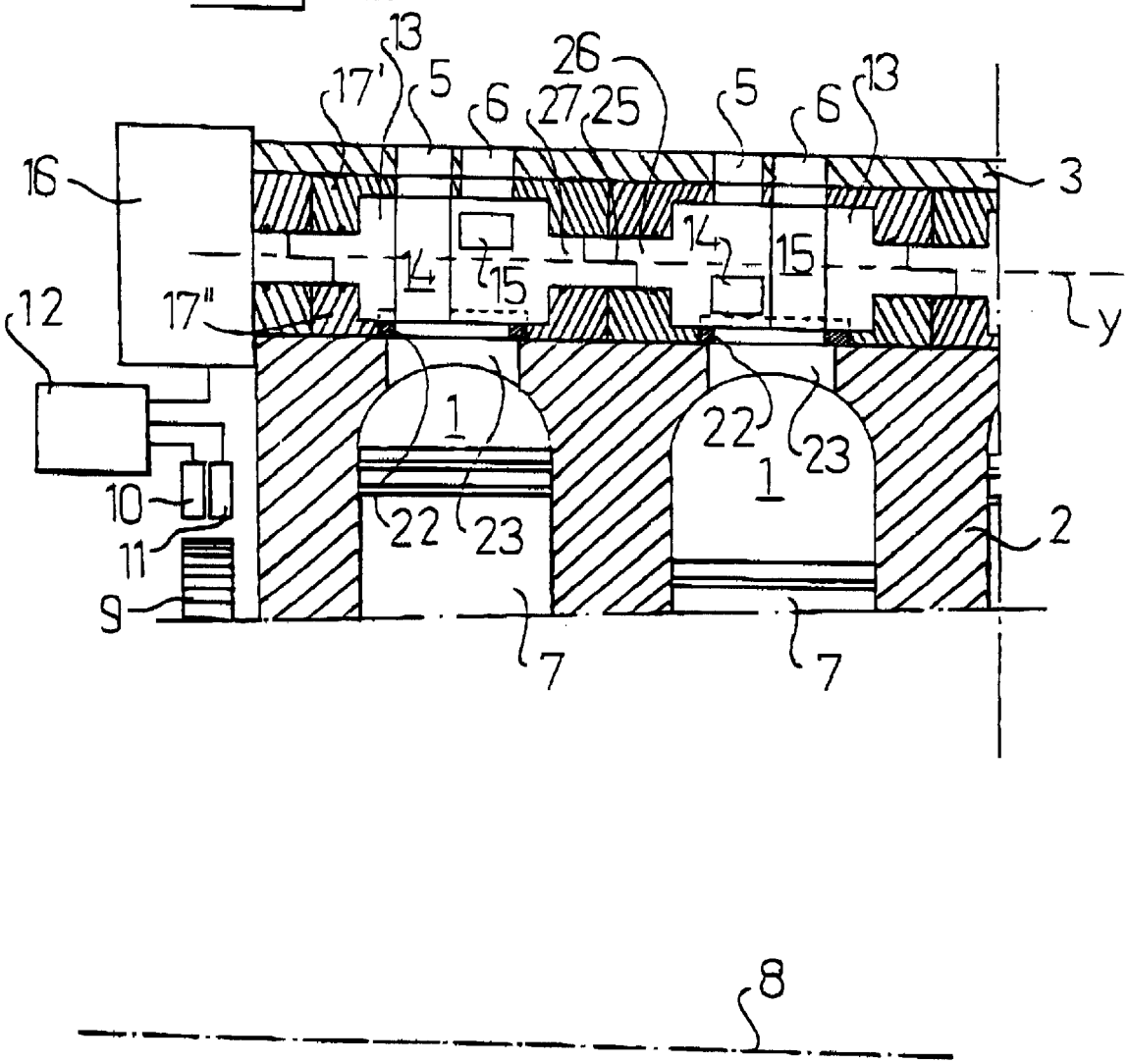
FIG. 3 discloses a longitudinal section through a part of a combustion engine similar to the one of FIG. 2 according to a second embodiment of the invention.

FIG. 3 discloses schematically a second embodiment of the invention. In the different embodiments, components having substantially the same function have been provided with the same reference signs. The second embodiment differs from the first embodiment merely in that the valve bodies 13 are connected to each other via a mechanical power transmission connecting member, which is disclosed schematically at 25 between two adjacent valve bodies 13. According to this embodiment, the power transmission element 19 between the sleeves 17', 17" is dropped. Each rotating valve body 13 includes an inlet shaft pin 26 and an outlet shaft pin 27. An outlet shaft 27 of a valve body 13 is thus mechanically connected at 25 to an inlet shaft pin 26 of an adjacent valve body 13. Also in this case, the sleeve 17', 17" together with the enclosed rotatable valve body 13 form a module unit which is easily replaceable. The shaft pins 26, 27 are sealed against the sleeve 17', 17" by means of sealing rings 28 extending around each shaft pin 26, 27.

Figure 4:
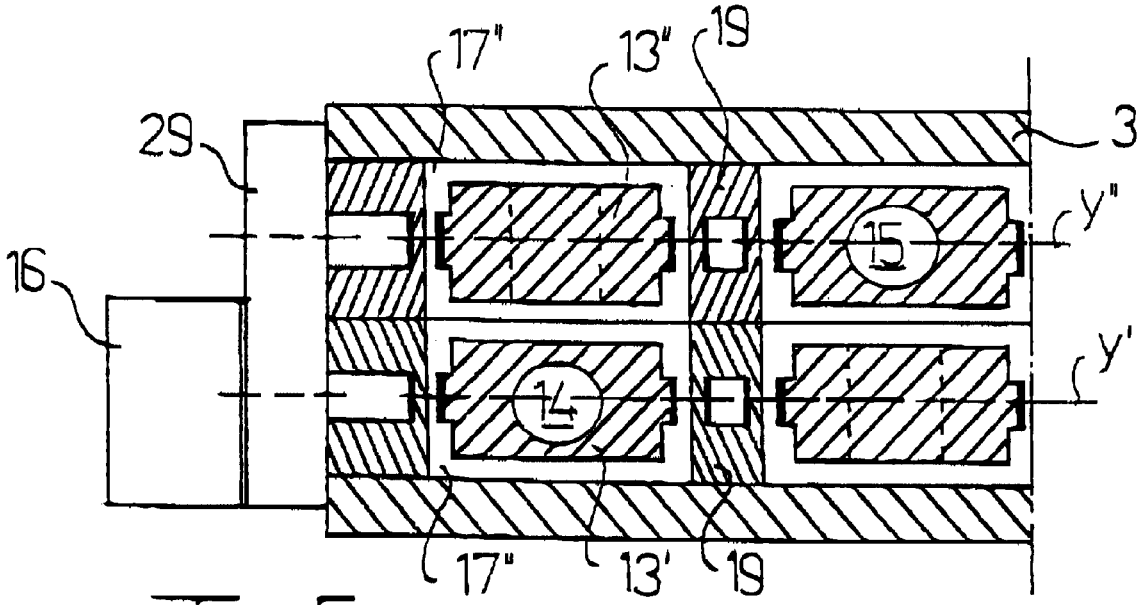
FIG. 4 discloses a longitudinal section through a part of a combustion engine with a valve device according to a third embodiment of the invention.

FIG. 4 discloses schematically a third embodiment of the invention having a separate rotatable valve body 13' for the inlet channel 5 and a separate rotatable valve body 13" for the outlet channel 6. The rotatable valve bodies 13', 13" are provided in such a way that their axes of rotation, y' and y", respectively, are parallel to each other. In the embodiment disclosed in FIG. 4, the two rotatable valve bodies 13', 13" have a common rotary motor 16, which rotates the valve bodies 13',13" via a power transmission member 29 having an inlet shaft and an outlet shaft which do not coincide.

Figure 5:
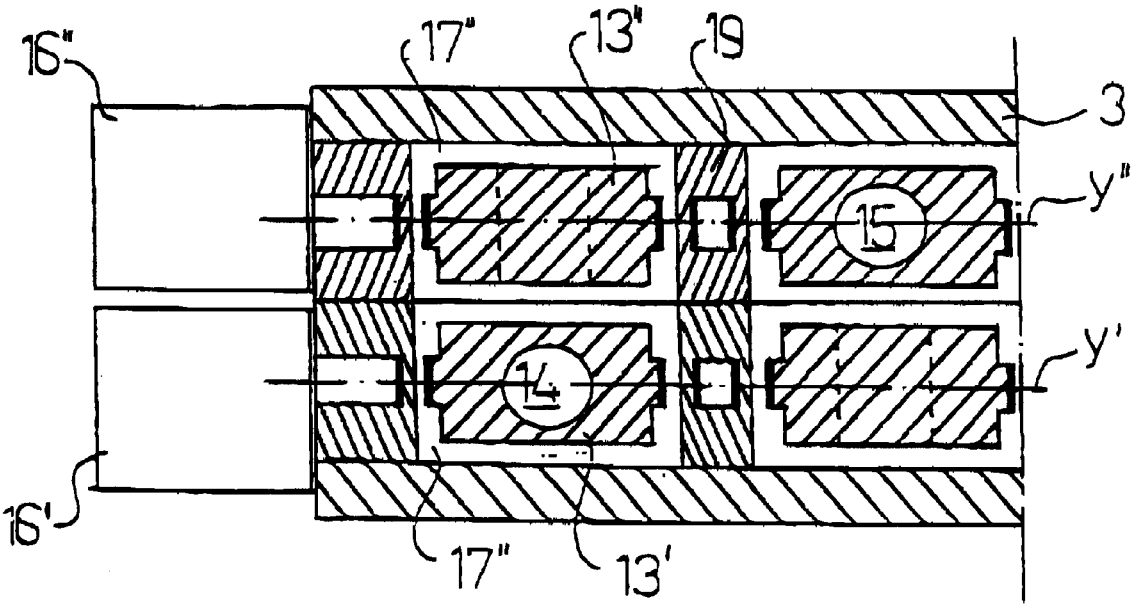
FIG. 5 discloses a transverse section through a part of a combustion engine similar to the one in FIG. 4 according to a fourth embodiment of the invention.

FIG. 5 discloses schematically a fourth embodiment, which merely differs from the embodiment of FIG. 4 in that the rotatable valve bodies 13' and 13" have been provided with a respective separate rotary motor 16', 16". It is thereby possible to control the rotating valve bodies 13 ' for the inlet channels 5 of the engine independently of the rotating valve bodies 13" for the outlet channels 6 the engine. Consequently, it is possible to phase displace the opening and/or closing points of time for the inlet channel 5 and the outlet channel 6 in relation to each other dependent on different engine parameters or states, for instance the number of revolutions or the load of the engine.

Figure 6:
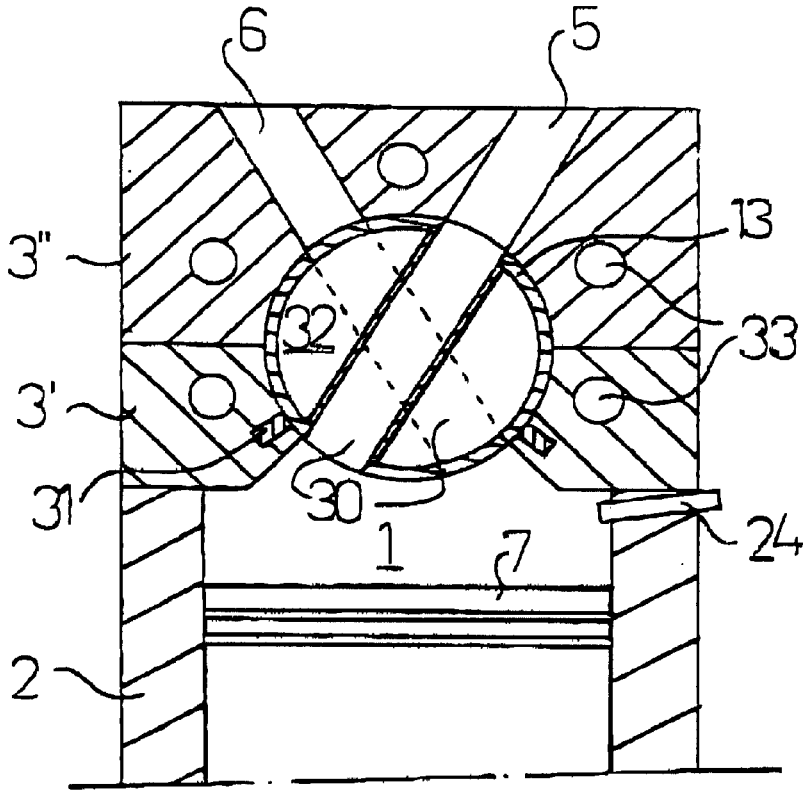
FIG. 6 discloses a longitudinal section through a part of a combustion engine with a valve body according to a fifth embodiment of the invention.

FIG. 6 discloses a fifth embodiment of the invention. In this embodiment, the valve body 13 is rotatably journalled in a circular cylindrical recess in a cylinder head including two parts 3' and 3", which are connected to each other along a dividing plane extending through a middle plane of the cylindrical recess. According to this embodiment, the valve body 13 includes merely one passage 30, which forms an inlet channel by the position disclosed in continuous lines, i.e. the passage 30 is in line with the inlet channel 5. In the position disclosed by dotted lines, the passage 30 forms an outlet passage together with the outlet channel 6. Preferably, the passage 30, seen in a cross-section through the passage, has a rectangular shape in order to achieve a cross-sectional area as large as possible. According to this embodiment, the valve body 13 will further form the upper limiting wall of the combustion chamber 1. Sealing members 31 may be provided in the lower part 3' of the cylinder head.

As appears from FIG. 6, the valve body 13 in this embodiment has a cavity 32, which contributes to a low weight of valve body 13 and thereby to a low moment of inertia. It is to be noted that in the embodiment disclosed above, the valve body 13 may have such a cavity 32. It is also possible to provide the valve body 13 with further cavities (not disclosed) in order to convey a cooling medium through the valve body 13. The cavity disclosed may also be arranged to receive a flow of a cooling medium.

The valve body 13 may advantageously be manufactured in aluminium or any other light metal or light metal alloy in the different embodiments. The outer surface of the valve body 13 may have a hardened layer, for instance of chromium nitrate.

FIG. 6 also discloses cooling channels 33 for the cooling of the cylinder head. Also the embodiments disclosed above may include such cooling channels 33. It ought to be possible to provide cooling channels 33 in such a manner that a cooling medium does not need to be conveyed through the valve body 13.

FIG. 6 illustrates a one-cylinder combustion engine. Thereby, the axis or rotation of the valve body 13 may either extend in parallel with the crank shaft of the combustion engine (not disclosed in FIG. 6) or perpendicular to the crank shaft of the combustion engine. By such an arrangement it is also possible to provide several cylinders in a row, where the axis of rotation of the valve body extends perpendicularly to the crank shaft of the combustion engine, and wherein each cylinder includes a separate valve body 13 and having its own separate rotary motor 16, not disclosed in FIG. 6. Thereby, very good possibilities to control individually the combustion process in the individual cylinders may be obtained.

Figure 7:
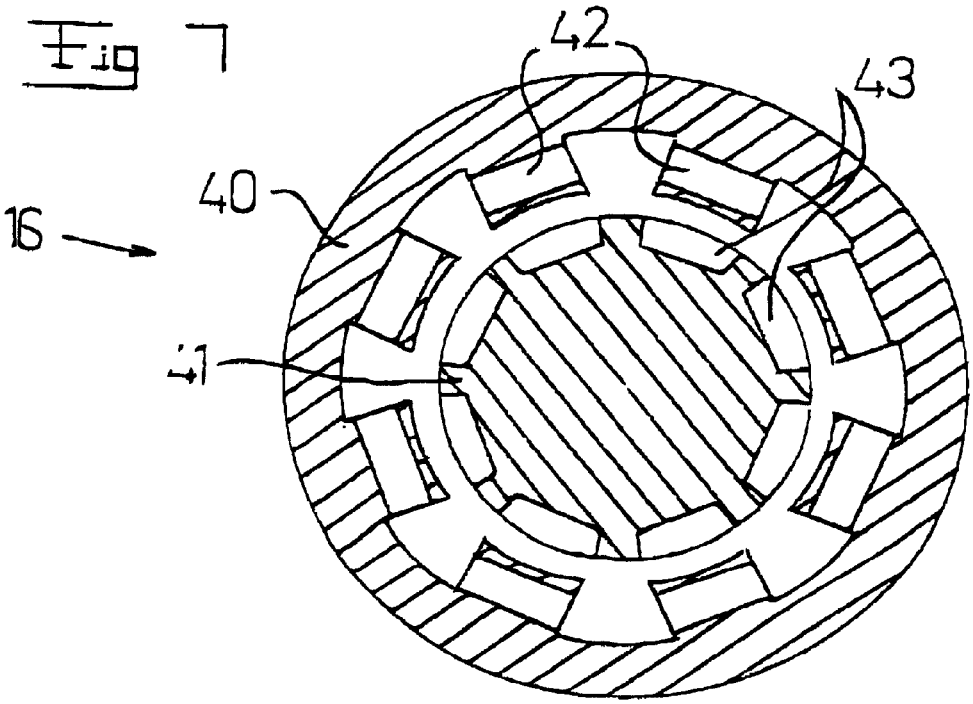
FIG. 7 discloses a cross-section through a rotary motor of the device according to the invention.

FIG. 7 discloses schematically the structure of the rotary motor 16 in the form of an electric synchronous motor. The synchronous motor, which is driven in one direction of rotation, preferably gives 0.5–0.7 Nm/4000 rpm. The synchronous motor disclosed has eight poles, but also synchronous motors having other numbers of poles may be employed, for instance four, six, ten, twelve poles. The synchronous motor includes, in a conventional manner, a stator 40 and a rotor 41. In the stator, there is a winding 42 for each pole and the rotor 41 has a corresponding number of magnets 43. The magnets 43 are of a type which includes samarium/cobalt and/or neodymium.

It is to be noted that the control unit 12 may be provided with a locking device, which is openable by inputting a code and which interrupts the electric connection between the control unit 12 and the sensor member 10 and 12. This may prevent an unallowable use of the vehicle when the control unit 12 is locked.

The present invention is not limited to the embodiments disclosed but may be varied and modified within the scope of the following claims.

For instance, it is to be noted that the separate rotary motor 16 also may be of another type than an electric motor. The valve device according to the invention is also realisable by a pneumatic rotary motor or a hydraulic rotary motor.

Furthermore, the possibility to provide a separate rotary motor for each valve body 13, 13', 13" is to be mentioned. Such rotary motors may be provided axially in relation to the valve bodies or be located laterally with respect to each valve body.

What is claimed is:

1. A valve device for a combustion engine including a combustion chamber and at least one channel for communication between the combustion chamber and an external space, the valve device comprising:

a rotatable valve body which is provided in said channel, said valve body including a passage extending in a direction through the valve body, the valve body being rotatable around an axis of rotation forming an angle to the direction of said passage which is arranged to form an open position and a closed position of said channel by rotation in one rotary direction around said axis of rotation; and a rotary motor separate from the combustion engine and arranged to provide said rotation, wherein the rotary motor is arranged to rotate said valve body from one of said positions to an adjacent of said positions by a first high rotation velocity, to rotate said valve body in this adjacent position by a second rotation velocity at a relatively lower rotation rate than said first high rotation velocity, and thereafter to rotate said valve body from said adjacent position to the next adjacent positions by the first high rotation velocity.

2. A valve device according to claim 1, wherein the rotary motor is arranged to provide the rotation of said valve body in a discontinuous manner.

3. A valve device according to claim 1, including a control unit is arranged to control the rotation of the rotary motor.

4. A valve device according to claim 3, wherein a first sensor member is operatively connected to said control unit and is arranged to sense the position of a crank shaft of said combustion engine.

5. A valve device according to claim 4, wherein the control unit is arranged to control the rotation of the rotary motor in response to the sensed crank shaft position.

6. A valve device according to claim 4, wherein said valve body is arranged to be controlled by means of the control unit in order to adjust the number of revolutions per time unit of the combustion engine.

7. A valve device according to claim 3, wherein a second sensor member is arranged to send the number of revolutions per time unit of said combustion engine, and that the control unit is arranged to control the rotation of the rotary motor in response to said number of revolutions.

8. A valve device according to claim 1, wherein the valve body includes at least one cavity apart from said passage.

9. A valve device according to claim 1, wherein the rotary motor includes an electric rotary motor.

10. A valve device according to claim 9, wherein the electric motor includes a synchronous motor.

11. A valve device according to claim 10, wherein said connecting member includes magnets including a material selected from the group comprising samarium/cobalt alloys and noedynium.

12. A valve device according to claim 1, wherein the rotary motor includes a pneumatic rotary motor.

13. A valve device according to claim 1, wherein said axis of rotation is substantially perpendicular to the direction of said passage.

14. A valve device according to claim 1, wherein said combustion engine includes more than one combustion chamber each having respective valve body and wherein said valve body for at least two combustion chambers have a common axis of rotation and are connected to each other by a power-transferring connecting member.

15. A valve device according to claim 14, wherein said connecting member includes a permanent magnet of each of said valve bodies and is arranged to enable contact-free power transmission from one valve body to an adjacent valve body.

16. A valve according to claim 14, wherein said connecting member includes a connecting element extending between two adjacent valve bodies.

17. A valve device according to claim 1, wherein said valve body is enclosed in a sleeve which is arranged to be received by a cylinder head of said combustion engine.

18. In a combustion engine having a combustion chamber and including an inlet channel for communication between the combustion chamber and an external space for the supply of air and fuel to the combustion chamber and an outlet channel for communication between the combustion chamber and an external space for the discharge of combustion gasses from the combustion chamber, the improvement comprising:

a first rotatable valve body which is provided in said inlet channel and including a first passage extending in a direction through the first valve body, the first valve body being rotatable around a first axis of rotation forming an angle to the direction of said first passage which is arranged to form an open position and a closed position of said inlet channel by rotation in one rotary direction around said first axis of rotation;

a second rotatable valve body which is provided in said outlet channel and including a second passage extending in a direction through the second rotatable valve body, the second valve body being rotatable around a second axis of rotation forming an oblique angle to the direction of said second passage which is arranged to form an open position and a closed position of said outlet channel by rotation in one rotary direction around said second axis of rotation; and a rotary motor separate from the combustion engine and arranged to provide said rotation of at least one of said first rotatable valve body and said second rotatable valve body, wherein the rotary motor is arranged to rotate each of said first and second valve bodies from one of said positions to an adjacent of said positions by a first high rotation velocity, to rotate each of said valve bodies in this adjacent position by a second rotation velocity at a relatively lower rotation rate than said first high rotation velocity, and thereafter to rotate each of said valve bodies from said adjacent position to the next adjacent positions by the first high rotation velocity.

19. A combustion engine according to claim 18, wherein the first valve body and the second valve body form a body with a common axis of rotation, wherein the direction of the first passage forms an angle to the direction of the second passage.

20. A combustion engine according to claim 19, wherein said angle between the directions of the first and second passages is between 30° and 60°.

21. A combustion engine according to claim 18, wherein the first valve body and the second valve body are driven by a common rotary motor.

22. A combustion engine according to claim 21, wherein a transferring unit having an input shaft and an output shaft, which do not coincide, is arranged to transfer a movement of rotation of the rotary motor to at least one of the valve bodies.

23. A combustion engine according to claim 18, including a second rotary motor, wherein the first valve body and the second valve body are driven by respective separate rotary motors.

24. A combustion engine according to claim 23, including a control unit arranged to control the rotation of the rotary motors and wherein the control unit is arranged to control the phase position of one of the valve bodies in relation to the phase position of the other valve body in response to the number of revolutions per time unit of the combustion engine.

* * * * *